US010207534B2

(12) United States Patent
Verdelli, Jr.

(10) Patent No.: US 10,207,534 B2
(45) Date of Patent: Feb. 19, 2019

(54) WRITING IMPLEMENT HOLDER

(71) Applicant: Angelo P. Verdelli, Jr., South Portland, ME (US)

(72) Inventor: Angelo P. Verdelli, Jr., South Portland, ME (US)

( * ) Notice: Subject to any disclaimer, the term of this patent is extended or adjusted under 35 U.S.C. 154(b) by 148 days.

(21) Appl. No.: 15/010,726

(22) Filed: Jan. 29, 2016

(65) Prior Publication Data

US 2016/0207346 A1 Jul. 21, 2016

Related U.S. Application Data

(63) Continuation-in-part of application No. 13/832,337, filed on Mar. 15, 2013.

(51) Int. Cl.
*B43K 23/004* (2006.01)
*B43K 29/00* (2006.01)

(52) U.S. Cl.
CPC ..... *B43K 23/004* (2013.01); *B43K 29/00* (2013.01)

(58) Field of Classification Search
CPC .... B43K 23/004; B43K 23/00; B43K 23/016; B43K 23/08; B43K 24/14; B43K 29/007; B43K 29/06; B43K 29/00
See application file for complete search history.

(56) References Cited

U.S. PATENT DOCUMENTS

| | | | | |
|---|---|---|---|---|
| 3,779,652 | A * | 12/1973 | Kunitoku | B43K 21/00 401/195 |
| 4,441,563 | A * | 4/1984 | Walton, II | A61B 17/162 173/167 |
| 4,522,522 | A * | 6/1985 | Zeitelhack | B43K 23/00 401/88 |
| 4,804,048 | A * | 2/1989 | Porth, Jr. | B25B 21/00 173/47 |
| 6,213,961 | B1 | 4/2001 | Reinsma | |
| 8,348,534 | B1 | 1/2013 | Brindise | |
| 2004/0148719 | A1 | 8/2004 | Lychwick | |
| 2005/0123340 | A1* | 6/2005 | Nunally | B43K 24/06 401/195 |
| 2005/0214057 | A1 | 9/2005 | Kato | |
| 2008/0056806 | A1 | 3/2008 | Crawford | |
| 2011/0243638 | A1* | 10/2011 | Jimenez | B43K 21/00 401/49 |

* cited by examiner

*Primary Examiner* — David Walczak
(74) *Attorney, Agent, or Firm* — AP Patents

(57) ABSTRACT

A writing implement holder comprises an elongated hollow housing. An electric motor is fixed at one end of the housing and having an output shaft thereof aligned with a longitudinal axis of the housing. A source of electric power is coupled to the motor. A gripping member is mounted within a hollow interior of the housing and has one end thereof securely attached to the output shaft of the motor. The gripping member is configured to receive a portion of the writing implement for a rotation with the output shaft of the motor, when the writing implement is inserted through an open end of the housing. Manually operable ON/OFF switch can be also provided. The housing can be provided by a pair of complimentary members.

18 Claims, 4 Drawing Sheets

WRITING IMPLEMENT HOLDER

CROSS-REFERENCE TO RELATED APPLICATIONS

This application is a Continuation-In-Part (CIP) of a prior U.S. Non-Provisional patent application Ser. No. 13/832,337 filed on Mar. 15, 2013, pending.

STATEMENT REGARDING FEDERALLY SPONSORED RESEARCH AND DEVELOPMENT

N/A

REFERENCE TO SEQUENCE LISTING, A TABLE, OR A COMPUTER PROGRAM LISTING COMPACT DISC APPENDIX

N/A

BACKGROUND

1. Technical Field

The subject matter relates to writing implements. It further relates to an electrically operated writing implement holder that is configured to reduce pressure required to be exerted onto a surface during writing and/or coloring activity. It additionally relates to an electrically operated writing implement holder that aids children and adults having fine motor skill difficulties 2. Description of Related Art The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Writing and/or coloring activity may require pressure to be applied by a writing implement onto the writing or coloring surface. Generally, such pressure is applied by a hand of the user of such writing implements. However, application of such pressure may be challenging to young children who have not developed fine motor skills or to adults who have diminished fine motor skills due to injury, disease and/or age.

Therefore, there is at least a need to reduce pressure required to be exerted by a person during writing and/or coloring activity onto a surface.

BRIEF DESCRIPTION OF THE DRAWINGS

The accompanying drawings are incorporated in and constitute part of the specification and illustrate various embodiments. In the drawings.

DETAILED DESCRIPTION OF EXEMPLARY EMBODIMENTS

Figure 1:
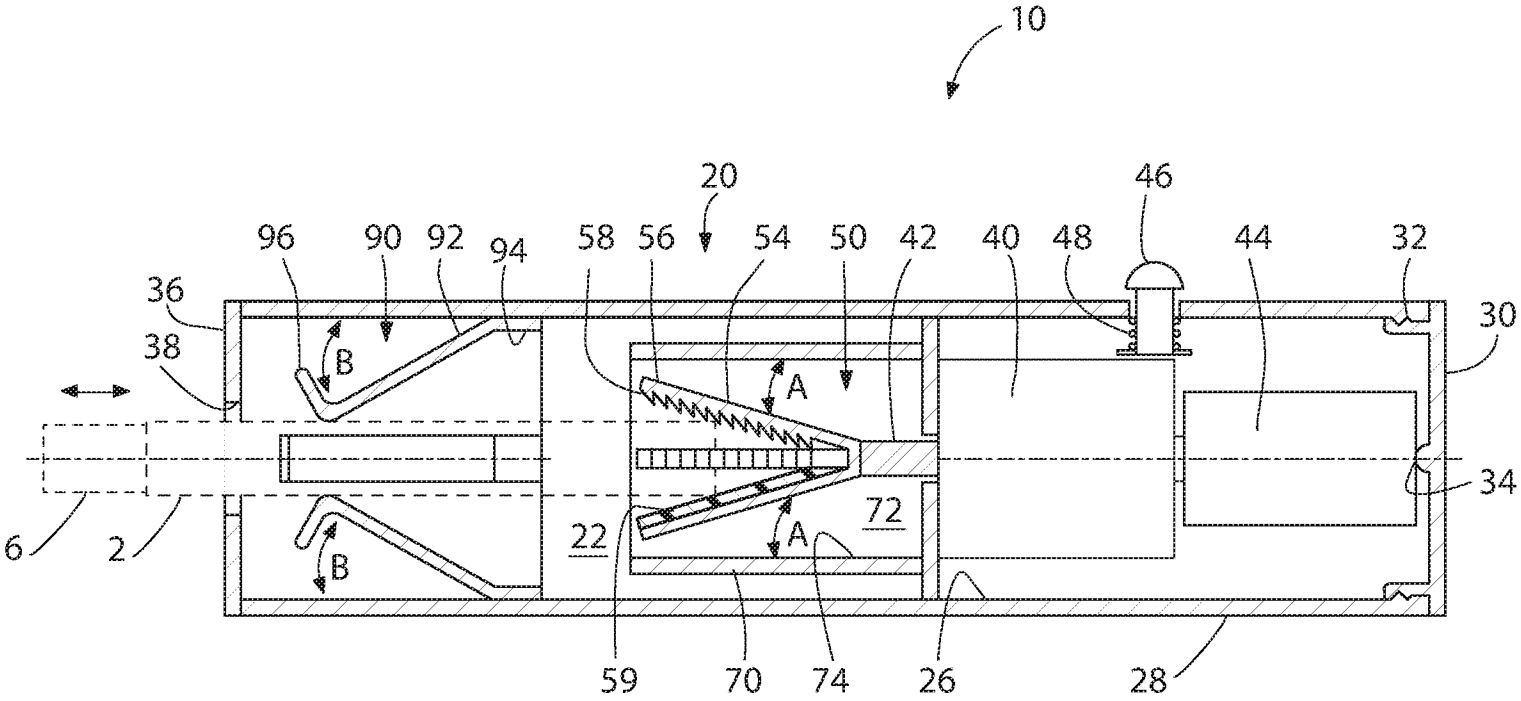
FIG. 1 illustrates a cross-sectional elevation view of an exemplary electrically embodiment of an operated writing implement holder.

Prior to proceeding to the more detailed description of the present invention, it should be noted that, for the sake of clarity and understanding, identical components which have identical functions have been identified with identical reference numerals throughout the several views illustrated in the drawing figures.

The following detailed description is merely exemplary in nature and is not intended to limit the described examples or the application and uses of the described examples. As used herein, the words "example", "exemplary" or "illustrative" means "serving as an example, instance, or illustration." Any implementation described herein as "example", "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," "exterior," "interior," and derivatives thereof shall relate to the invention as oriented in the Figures. Furthermore, there is no intention to be bound by any expressed or implied theory presented in the preceding technical field, background, or the following detailed description. It is also to be understood that the specific devices and processes illustrated in the attached drawings, and described in the following specification, are simply examples of the inventive concepts defined in the appended claims. Hence, specific dimensions and other physical characteristics relating to the examples disclosed herein are not to be considered as limiting, unless the claims expressly state otherwise.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention are provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

The particular embodiments of the present disclosure generally provide devices and methods directed to an electrically operated writing implement holder.

In particular embodiments, the electrically operated writing implement holder includes an elongated hollow housing. An electric motor is fixed at one end of the housing and has an output shaft thereof aligned with a longitudinal axis of the housing. A source of electric power is coupled to the motor. A gripping member is mounted within a hollow interior of the housing and has one end thereof securely attached to the output shaft of the motor. The gripping member is configured to receive one end portion of the writing implement for a rotation with the output shaft of the motor when the writing implement is inserted through an axially opposite open end of the housing. A manually operated switch can be provided to supply and discontinue supply of electric power to the motor. Optional means for restraining radial movement of the writing implement at an end of the housing being axially opposite the end having the motor attached thereto may be also provided.

In particular embodiments, the housing is provided adjustable in length by way of two telescopic or threaded sections.

Now in reference to FIGS. 1-4, therein is illustrated an exemplary embodiment of an electrically operated writing implement holder 10 configured to hold and rotate a writing implement 2. The writing implement 2 can be, without limitations, a marker, pencil, pen, crayon and the like writing implements.

The exemplary holder 10 includes a housing 20 having a hollow interior 22. The housing 20 can be provided as an elongated member wherein its length is greater than its width or diameter. An inner surface 26 and an outer surface 28 can be spaced from each other to define a generally uniform thickness of the wall 24. The inner surface 26 and an outer surface 28 can be so configured that the wall thickness is not uniform. For example, outer surface 28 can be adapted with curved portions (not shown) to improve ergonomics of grasping the holder 10 during use. The housing 20 also defines a longitudinal axis 12 of the holder 10. The housing 20 can have a ring shaped cross-section in a plane normal to the longitudinal axis 12. The exterior surface 28 of the housing 20 can be configured with other cross-sectional shapes, for example such as a square, a triangle, an oval and can include, at least partially, curved segments.

One end of the housing 20 is closed, for example by an end member 30 having a threaded arrangement 32 with the housing 20. The member 30 is adapted with an electrical contact 34 and may be further adapted with a bias spring (not shown) that is configured to bias the power source. The axially opposite end of the housing 20 may be open. The axially opposite end of the housing 20 can be closed with the member 36 having an axial aperture 38 formed through a thickness thereof. Aperture 38 would be sized to accommodate either a specific type of writing implement 2 or sized to accommodate writing implements 2 of various cross-sectional sizes.

An electric motor 40 is fixed at one end of the housing 20 and has an output shaft 42 thereof aligned with the longitudinal axis 12. A power source 44 of electric power is electrically coupled to the motor 40. The subject matter contemplates that the motor 40 and the power source 44 are mounted in any of the conventional ways of mounting such devices in other applications, for example such as toothbrush or a hand tool. It is also contemplated herewithin that the member 30 may be replaced with a section of the housing 20 adapted with an elongated cover (not shown) in a snap type and/or fastened arrangements to selectively expose or cover motor 40 and power source 44.

The electrical circuit could be so constructed and the power source 44 could be so mounted that motor 40 is energized when the holder 10 is in a generally upright position with the writing implement 2 facing downwardly and the power source 44 is in contact with the motor 40. The holder 10 can be also adapted with an optional manually operable switch 46 having contacts thereof coupled in a circuit mediate the electric motor 40 and the power source 44 and operable to selectively supply electric power to the motor 40 and discontinue supply of the electric power. In one form, the switch 46 may be of a pushbutton type adapted with the spring 48 or may be of a sliding type. Both the electric motor 40 and the power source 44 are shown in FIG. 1 absent of internal structure or connections, for example such as wires, which is conventional in the art. For example, the motor 40 may be of the type as used in battery operated toothbrushes and power source 40 may be any conventional battery of a disposable or a rechargeable type.

In another form, touch switch, for example of a capacitance type (not shown) with appropriate electrical circuitry (not shown) may be provided to energize the motor 40 when the user grabs the outer surface 28 of the housing 20. Such touch switch may be of the type presently employed on selected kitchen and/or bathroom water faucets.

Furthermore, the switch 46 can be configured in a sliding rheostat type to provide adjustable rotational speed of the output shaft 42.

A gripping means or member, of one exemplary embodiment being referenced with numeral 50, is mounted within the hollow interior 22 of the housing 20 and has one end 52 thereof securely attached or coupled to the output shaft 42 of the motor 40. The gripping member 50 is configured to receive one end or end portion of the writing implement 2 and at least prevent the writing implement 2 from spinning or rotating relative to rotation of the output shaft 42. In other words, the gripping member 50 receives the writing implement 2 so that such writing implement 2 rotates with the motor shaft 42 when the writing implement 2 is inserted through an axially opposite generally open end of the housing 20.

The gripping member 50 can be configured to accommodate writing implements 2 of different cross-sectional shapes and/or sizes. By way of one example only, the gripping member 50 is defined by plurality of members 54, which can be elongated, each having a proximal end thereof coupled to the output shaft 42 and extending at an incline from the output shaft 42 toward the inner surface 24 of the housing 20, wherein one or more of the distal ends 56 of the plurality of members 54 can be adapted for movement in a radial direction relative to the longitudinal axis 12 of the writing implement holder 10, as is best shown by arrows A. One or more of the plurality of members 54 may include a plurality of teeth 58 positioned to engage an exterior surface 4 of the writing implement 2 or may include elastomeric member 59 attached thereto, the elastomeric member 59 being positioned to engage the exterior surface 4 of the writing implement 2.

The holder 10 may further include another or second hollow housing 70 disposed within a hollow interior 22 of the housing 20 and wherein the gripping member 50 is generally positioned within a hollow interior 72 of the another or second housing 70. The function of the another or second housing 70 is to restrict radial expansion of the gripping member 50, wherein the distal ends 56 of the plurality of elongated members 54 are allowed to touch inner surface 74 of the another or second housing 70.

Figure 2:
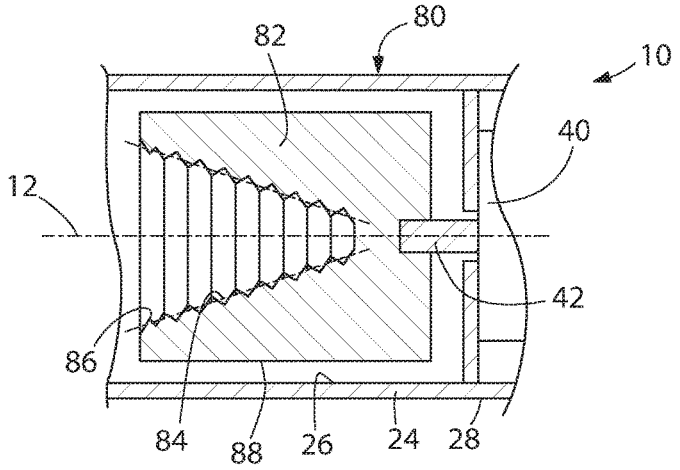
FIG. 2 illustrates a partial cross-sectional elevation view of the electrically operated writing implement holder of FIG. 1, particularly illustrating one form of a gripping member.
Figure 5:
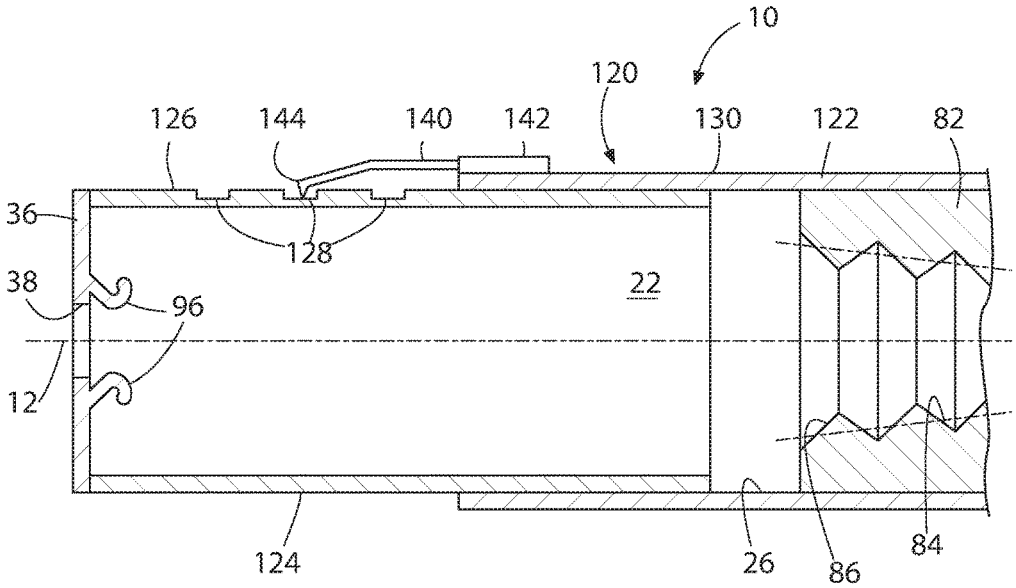
FIG. 5 is a partial cross-sectional elevation view of the electrically operated writing implement holder of FIG. 1, particularly illustrating an adjustable length housing of one form.

In accordance with another form, best shown in FIG. 2, the writing implement holder 10 can include a gripping member 80 defining another or second housing 82 having one end thereof attached to the output shaft 32, a conical or frustoconical inner bore 84 and a thread 86 formed on a surface of the conical or frustoconical inner bore 84. The thread 86 is configured to engage the exterior surface 4 of the writing implement 2. The exterior surface 88 of the second housing 82 may be separated by a peripheral gap from the inner surface 26 of the hollow housing 20 or be in a direct abutting contact therewith, as is best shown in FIG. 5. Furthermore, thread 86 may be of any other suitable arrangement, for example such as teeth, spline or elastomeric member, suitable to grip the end or end portion of the writing implement 2 in a manner at least preventing independent rotation thereof relative to the rotation of the output shaft 42, although a small slippage, not sufficient to destroy operability of the holder 10, is allowed due to manufacturing tolerances, variations of the writing implement 2, etc.

The writing implement holder 10 may include an optional means, generally designated as 90, for at least restricting radial movement of the writing implement 2 during rotation thereof. By way of one example only, such means 90 may include the axial aperture 38 having its circumference sized to directly abut or be position. By way of another example of FIG. 1, the means 90 is configured to include one or more members or fingers 92 secured to an inner surface 24 of the housing 20 and being configured to at least partially collapse and return to the original position in a resilient manner, as illustrated by arrows B, so as to receive the writing implement 2 therethrough. Such members or fingers 92 may be provided as separate members or may be provided in a unitary type construction having a common proximal end 94 being affixed to the inner surface 24 of the housing 20. The distal end 96 of one or more members or fingers 92 may be configured to curve away from the longitudinal axis 12 and the exterior surface 4 of the writing implement 2 so as to ease insertion of the writing implement 2 and guide the writing implement 2 into a position aligned with the longitudinal axis 12 and further guide the insertion of the writing implement 2 into the gripping member 50. As is also seen in FIG. 1, members or fingers 92 may be generally inclined to the longitudinal axis 12 in a plane generally parallel thereto.

The members or fingers 92 can be manufactured from spring steel material, elastomeric material and any combination thereof. For example, the proximal end 94 may be of a rigid construction afforded by conventional metals and/or engineered plastics.

Figure 3:
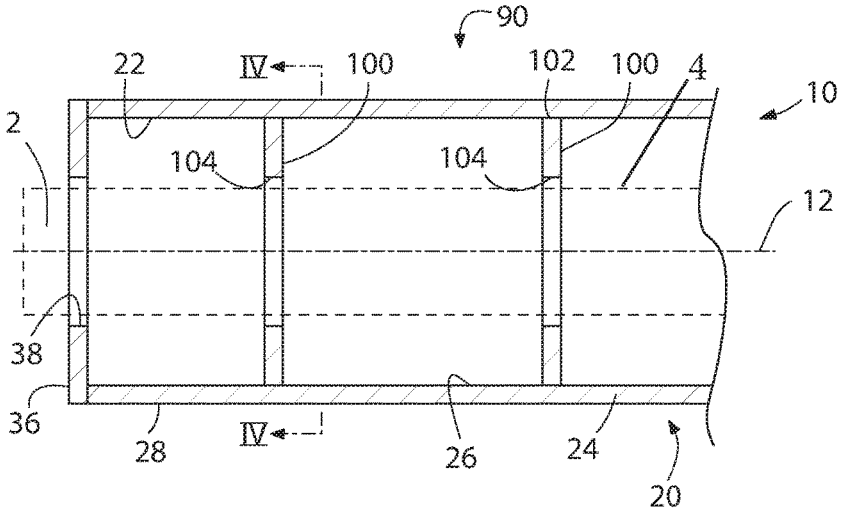
FIG. 3 illustrates a partial cross-sectional elevation view of the electrically operated writing implement holder of FIG. 1, particularly illustrating an optional arrangement for restraining radial movement of the writing implement.
Figure 4:
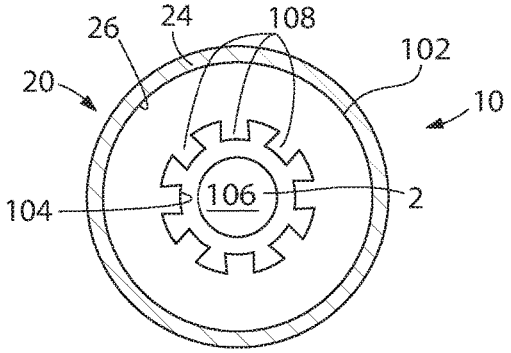
FIG. 4 illustrates a cross-sectional view of the electrically operated writing implement holder along lines IV-IV of FIG. 3.

By way of another example of FIGS. 3-4, such means 90 may comprise one or more members 100 disposed in a plane being generally normal to the longitudinal axis 12 and having an outer edge and/or surface 102 thereof affixed to the interior surface 22 of the housing 20. The inner edge and/or surface 104 defines an axial aperture 106 and a plurality of teeth or fingers 108 disposed in a spaced apart relationship with each other along the edge and/or surface 104 and that are configured to resiliently flex in a direction along the longitudinal axis 12 when the writing implement 2 is inserted through the aperture 106. It is further contemplated that, the plurality of teeth or fingers 108 do not have to touch the exterior surface 4 but be configured so as to restrain the radial movement of the writing implement 2 and, particularly the tip 6, during rotation thereof, sufficiently to allow proper use and operation of the holder 10.

In accordance with another form of the invention of FIG. 5, the holder 10 can include a hollow housing, generally designated as 120, that is configured to adjust to different length and, therefore, includes means for adjusting a length of the housing 120. Exemplarily, the housing 120 can be configured to include a first portion 122 having the motor 40 and the power source 44 disposed therewithin and a second portion 124 configured for a longitudinal reciprocal movement relative to the first portion 124. More specifically, the first and second portions, 122 and 124 respectively, can be provided as a pair of telescopic portions, wherein the second portion 124 can include one or more indentations 128 defined on an exterior surface 126 thereof along a length of the second portion 124 and wherein the writing implement holder 10 includes a clip 140 having one end 142 thereof fixed to an exterior surface 130 of the first portion 122 and having an opposite end 144 thereof configured for engagement with a selective one from the one or more indentations 128. It would be understood that the positions of the indentations 128 and the clip 140 can be reversed between the first and second portions, 122 and 124 respectively.

Figure 6:
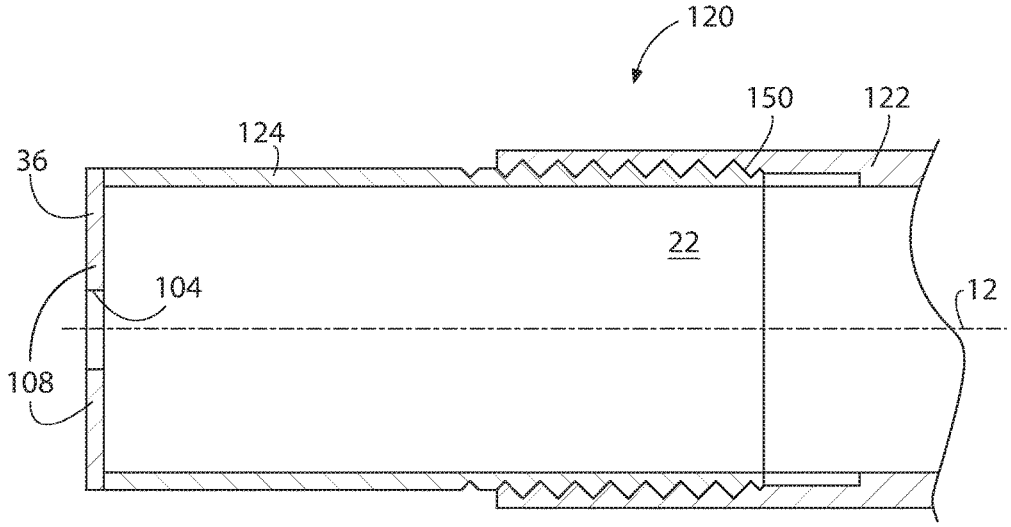
FIG. 6 is a partial cross-sectional elevation view of the electrically operated writing implement holder of FIG. 1, particularly illustrating an adjustable length housing of another form.

In accordance with another form of the invention of FIG. 6, the first and second portions, 122 and 124 respectively, may be adapted with complimentary threaded arrangement 150.

The adjustable housing 120 not only can accommodate writing implements 2 of different lengths but can also control extension of the tip 6 of the writing implement 2 past the free end of the second portion 124 in order to restrict the radial movement of such extending end of the writing implement 2. The remaining features of the holder 10, described in a combination with the housing 20, apply to the exemplary forms of FIGS. 5-6 and their description is omitted herein for the sake of brevity.

The subject matter also contemplates that the end member 36 may be configured to incorporate the above described teeth or fingers 108 as part of the end member 36 and also contemplates that the end member 36 can be adapted with curved end portions 96.

Figure 7:
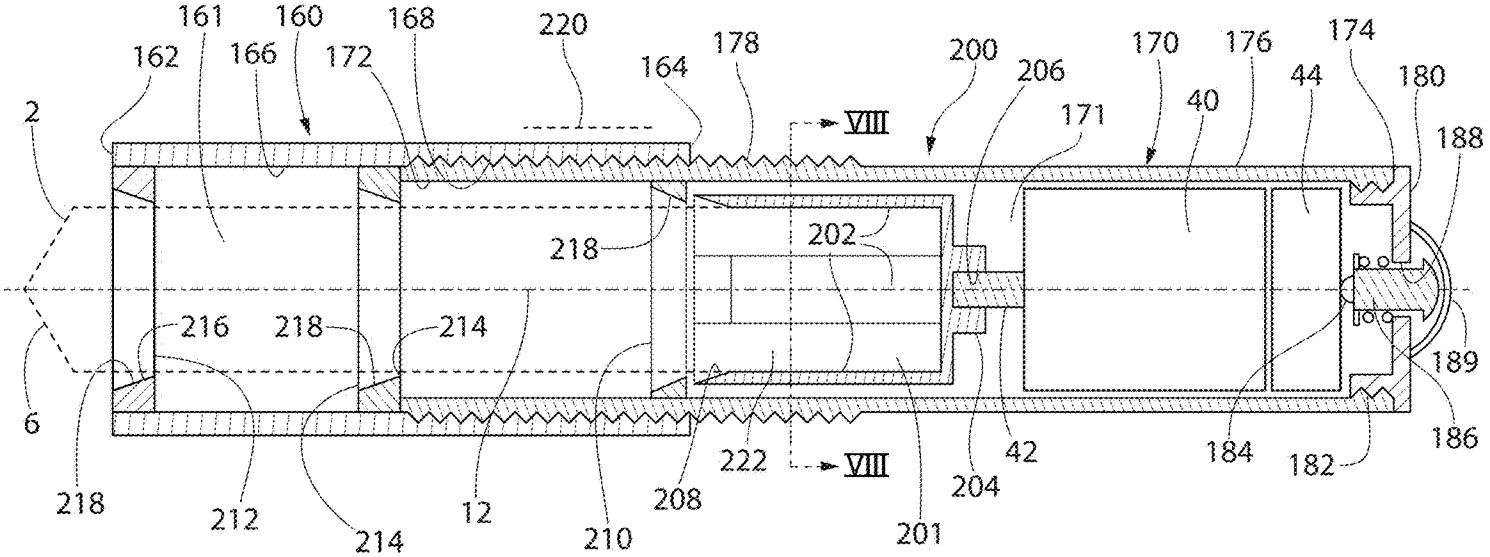
FIG. 7 illustrates a cross-sectional elevation view of an exemplary embodiment of an electrically operated writing implement holder.
Figure 9:
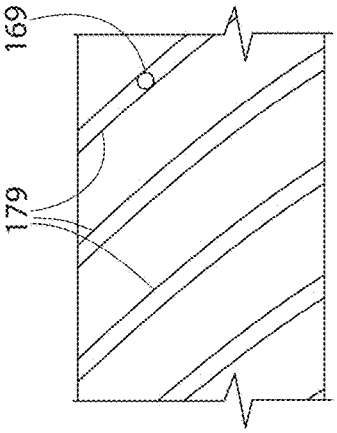
FIG. 9 illustrates a partial elevation view of one form of the arrangement to adjust lengths of housing members employed within the electrically operated writing implement holder of FIG. 7.
Figure 8:
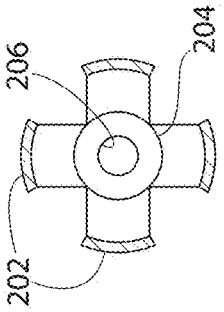
FIG. 8 illustrates a partial cross-section view along line VII-VIII in FIG. 7.

FIGS. 7-9 illustrate another exemplary embodiment of the writing implement holder 10 that comprises a housing 160, a housing 170, and end member 180, the motor 40, the power source 44 and a gripping member 200.

The housing 160 defines a hollow interior 161, an open end 162 and an axially opposite or another open end 164. The housing 160 also has a thread 168 formed on an interior surface 166. It is not necessary that a length of the thread 168 spans the entire length of the housing 160. The housing member 160 may be configured as an elongated housing member, having a length thereof being greater than a width or a diameter thereof.

The housing 170 defines a hollow interior 171, an open end 172 and an axially opposite or another end 174. The above described motor 40 and power source 44 are mounted within the hollow interior 171 adjacent one end, shown as the end 174. The housing 170 also has a thread 178 formed on a portion of an exterior surface 176 adjacent the end 172. The housing member 170 may be configured as an elongated housing member, having a length thereof being greater than a width or a diameter thereof.

In this exemplary form, the thread 178 compliments the above described thread 168 and both threads provide means for incrementally adjusting overall length of the holder 10 so as to expose a working portion of the writing implement 2, adjacent tip 6 thereof, past the end 162 of the housing member 160.

In one exemplary form, the threads 168 and 178 may be replaced with a spline 179 formed for example in the exterior surface 176 of the housing member 170 and a pin or abutment 169 extending from the interior surface 166 of the housing member 160, as is best shown in FIG. 8, where the overall length of the holder 10 between ends 162 and 174 is adjusted by simply rotating housing members 160 and 170 toward each other to decrease the length of the holder 10 exposing a length portion of the writing implement 2 disposed within hollow interiors 161 and 171 or away from each other to increase the length of the holder 10, for example when a new writing implement 2 is to be used.

The end 174 is closed during use of the holder 10, for example with an end member 180 having a threaded arrangement 182 with the housing 170. The member 180 can be adapted with an electrical contact 184. The contact 184 may be a stationary contact similar to the above described contact 34. The contact 184 may be a movable contact provided within the switch 186 mounted through an aperture 188 in the end member 180. An optional flexible seal or a cover 189 may be also provided on an exterior surface of the member 180. The switch 36 may be also mounted within the hollow interior 171 with the seal or cover 189 having a portion (not shown) that can protrude into the aperture 188 and actuate switch 46. The contact 184 can be also mounted on such portion (not shown) so as to eliminate the switch 46 but energize motor 40 when the seal or cover 189 is depressed in a direction toward the motor 40.

The holder 10 also includes a gripping member 200 configured to receive and retain the writing implement 2 and at least prevent if not completely eliminate radial slippage, spinning or rotation of the writing implement 2 relative to the rotation of the output shaft 42. In other words, the gripping member 200 receives and retains the writing implement 2 within the hollow interior 201 such that the writing implement 2 rotates with the output shaft 42 after the writing implement 2 is inserted into the hollow interior 171 of the housing 170. The gripping member 200 may be configured to include two or more tangs or fingers 202 extending from a common base 204 and defining a hollow interior 201 of the gripping member 200. The gripping member 200 may be configured to include four tangs or fingers 202, as is best shown in FIG. 9, particularly when the writing implement 2 has a cylindrical shape. The width of one or more tangs or fingers 202 may have an arcuate or curved shape. The base 204 is configured for attachment or coupling to the output shaft 42, for example by way of a bore 206, or can be provided integral with the output shaft 42 prior to assembly of the output shaft 42 into the motor 40. The tangs or fingers 202 can be also directly connected to the output shaft in a manner illustrated in FIG. 1, so as to eliminate the bore 206 if not even the base 204. A distal free end 208 of one or more tangs or fingers 202 may be tapered to ease insertion of the writing implement 2 into the gripping member 200. One or more of the tangs or fingers 202 may be provided as rigid members. One or more of the tangs or fingers 202 may be provided as flexible members, for example being manufactured from a spring steel, to accommodate variations in the size of the exterior surface or circumference of the writing implement 2. One or more of the tangs or fingers 202 may be disposed generally parallel to the plane of the longitudinal axis 12 of the holder 10. One or more of tangs or fingers 202 may be tapered inwardly toward the longitudinal axis 12 so as to accommodate writing implements 2 of different sizes. It is not necessary for the tangs or fingers 202 to be separated by a gap along lengths thereof and or one or more of the bridging or connecting portions 222 are also contemplated herewithin, especially when the gripping member 200 is provided as a rigid member.

In one form, the gripping member 200 may be provided as the above described gripping member 50 or 80.

In one form, the gripping member 200 may be provided as a one-piece singular member having a continuous peripheral wall extending from the base 204 or from the output shaft 42 and defining such hollow interior 201 being sized and shaped to receive writing implement 2.

In one form, the distal end 208 may be positioned in a close proximity or closely adjacent the open end 172 of the housing member 170. In one form, the distal end 208 may be positioned even with the open end 172 of the housing member 170. In one form, the distal end 208 may be positioned mediate the ends 172 and 174 of the housing 170.

The exemplary holder 10 of FIGS. 7-9 may be also adapted with one or more optional guide members configured to guide insertion of the writing implement 2 at least into the hollow interiors of housing member 160 and 170 and even further into the hollow interior 201 of the gripping member 200. One such guide member, referenced with numeral 210 can be positioned adjacent the distal end 208 of one or more tangs or fingers 202. One such guide member, referenced with numeral 212 can be positioned at an open end 162 of the housing member 160. One such guide member, referenced with numeral 214 can be positioned mediate the ends 162 and 164 of the housing member 160. The holder 10 of FIGS. 7-9 can be provided with only the guide members 210 and 212. The holder 10 of FIGS. 7-9 can be provided with only the guide members 212 and 214. The holder 10 of FIGS. 7-9 can be provided with only the guide members 210 and 214. When three guide members 210, 212, 214 are provided, the guide member 214 can be positioned mediate the other guide members 210 and 212.

In one form, the guide member 212 can be attached to or made integral with the end 162 of the housing 160. For example, the size of outer surface of the guide member 212 can be made slightly larger than the size of the inner surface 166 of the housing 160 so as to assemble, mount or install the guide member by way of a friction fit.

In one form, the guide member 214 can be attached to or made integral with the end 172 of the housing 170.

In one form, one or more of the guide members 210, 212, 214 can be provided as a disk shaped member having a center bore 216 with a tapered or frustoconical surface 218.

In one form, one or more of the guide members 210, 212, 214 can be provided as a disk shaped member having a center bore 216 with a tapered surface 218, where the center bore 216, at its smallest opening, is sized shaped about equal to a size and shaped of the hollow interior 201 of the gripping member 200.

In one form, one or more of the guide members 210, 212, 214 can be provided as a disk shaped member having a center bore 216 with a tapered surface 218, where the center bore 216, at its smallest opening, is sized shaped about equal to a size and shaped of the hollow interior 201 of an exterior peripheral surface of the gripping member 200.

In one form, one or more of the guide members 210, 212, 214 can be provided as a disk shaped member having a center bore 216 with the above described fingers 108.

In one form, one or more of the guide members 210, 212, 214 can be provided as a disk shaped member having a center bore 216 that is sized smaller than the circumference of the writing implement 2 and which is configured to flex, in a resilient manner, upon passage of the writing implement 2 therethrough and abut the exterior surface 4 of the writing implement 2 after its insertion into the holder 10.

It would be understood that the one or more guide members 210, 212, 214 are also configured and operable to restrict if not completely eliminate radial movement of the writing implement 2, particularly the tip 6 thereof, during use of the holder 10.

In operation, the user inserts the writing implement 2 into the hollow interior of the housing 20, 120, or 160 and 170 until a portion of the writing implement 2 is securely gripped and retained by the gripping member 50, 80, or 200 within the hollow interior thereof, sufficiently enough so that the writing implement 2 rotates with the output shaft 42 when the motor 40 is energized from the power source 44.

When the holder 10 is provided of FIGS. 7-9, the user can either grasp the outer surface of the housing 160 or the outer surface of the housing 170. Either outer surface can be adapted, either partially or completely, with slip resistant features, for example such as polymer coating or sleeve 220.

In one form, outer surface can be smooth. In one form, either outer surface can be adapted with curved portions to improve ergonomics of the holder 10.

If the invention is to be used by small child, than a parent or a guardian can insert the writing implement 2 and energize the motor 44, for example by way of a switch, such as above described switch 46. When the writing implement 2 rotates, the small child has to only bring the tip of the writing implement 2 in contact with the paper or other working surface without the need to apply pressure. When the tip 6 is in close proximity to the end of the housing 20, 120, the writing implement 2 is replaced, in view of housing 20, or the length of the housing 120 or 160 and 170 is adjusted to uncover previously hidden usable length portion of the writing implement 2. The holder 10 can be used for both coloring and writing activities.

The housings 20, 122, 124, 160 and 170 can be manufactured from plastic, polymer, metal, wood or any combinations of such materials.

The method of at least reducing pressure generally exerted by a person during coloring or writing activities comprises providing an electrically operable writing implement holder, inserting the writing implement into the hollow interior of the holder housing, gripping, with a gripping member, a portion of the writing implement, energizing a motor so that the writing implement rotates with the rotation of the output shaft of the motor.

It will be understood that the same benefits will be realized by an adult whose fine motor skills diminished due to injury, disease and/or age.

In one exemplary embodiment, the electrically operated writing implement holder aids children and adults having fine motor skill difficulties.

In one exemplary embodiment, the electrically operated writing implement holder reduces pressure required to be exerted onto a surface during writing and/or coloring activity.

In one exemplary embodiment, the electrically operated writing implement holder is configured for writing implements of various cross-sectional sizes.

In one exemplary embodiment, the electrically operated writing implement holder is configured for writing implements of various lengths.

In one exemplary embodiment, the electrically operated writing implement holder includes a linearly adjustable housing.

In one exemplary embodiment, the electrically operated writing implement holder includes an internally disposed gripping member.

In one exemplary embodiment, the electrically operated writing implement holder includes means to at least restrict radial movement of the writing implement during rotation thereof.

In one exemplary embodiment, the electrically operated writing implement holder includes a pair of housings that are axially movable in a relationship to each other by way of a spline provided in an outer surface of one housing and a pin or abutment extending from an interior surface of another housing.

In one exemplary embodiment, an electrically operated writing implement holder comprises a housing comprising a hollow interior and an open end; an electric motor fixed at one end of the housing within the hollow interior thereof, the electric motor comprising an output shaft thereof aligned with a longitudinal axis of the housing; a source of electric power coupled to the motor; and a gripping member mounted within the hollow interior of the housing and having one end thereof securely attached to the output shaft of the motor so the gripping member rotates with a rotation of the output shaft, the gripping member configured to receive and retain, within a hollow interior thereof, a portion of the writing implement for a rotation with the output shaft of the motor, when the writing implement is inserted through the open end of the housing.

In one exemplary embodiment, an electrically operated writing implement holder comprises a housing comprising a hollow interior, an open end and a thread on an exterior surface of the housing; an electric motor disposed within the hollow interior at one end of the housing and having an output shaft thereof aligned with a longitudinal axis of the housing; a source of electric power disposed within the hollow interior and coupled to the motor; a gripping member mounted within the hollow interior of the housing and having one end thereof securely attached to the output shaft of the motor so the gripping member rotates with a rotation of the output shaft, the gripping member comprising one or more tangs or fingers defining a hollow interior of the gripping member, the gripping member being configured to receive and retain, within the hollow interior thereof, a portion of the writing implement for a rotation with the output shaft of the motor, when the writing implement is inserted through the open end of the housing; another housing comprising a hollow interior, an open end and a thread on an interior surface of the another housing and being complimentary to the thread on the exterior surface of the housing; and a switch operatively coupled in a circuit mediate the electric motor and the power source and operable to selectively supply and discontinue supply of electric power to the motor.

In one exemplary embodiment, an electrically operated writing implement holder comprises a housing comprising a hollow interior, an open end and a thread on an exterior surface of the housing; an electric motor disposed within the hollow interior at one end of the housing and having an output shaft thereof aligned with a longitudinal axis of the housing; a source of electric power disposed within the hollow interior and coupled to the motor; a gripping member mounted within the hollow interior of the housing and having one end thereof securely attached to the output shaft of the motor so the gripping member rotates with a rotation of the output shaft, the gripping member comprising one or more tangs or fingers defining a hollow interior of the gripping member, the gripping member being configured to receive and retain, within the hollow interior thereof, a portion of the writing implement for a rotation with the output shaft of the motor, when the writing implement is inserted through the open end of the housing; another housing comprising a hollow interior, an open end and a thread on an interior surface of the another housing and being complimentary to the thread on the exterior surface of the housing, the gripping member comprising two or more fingers coupled to the output shaft and tapers at free distal ends of the two or more fingers; one or more guide members having a center bore with a tapered surface; and a switch operatively coupled in a circuit mediate the electric motor and the power source and operable to selectively supply and discontinue supply of electric power to the motor.

In one exemplary embodiment, an electrically operated writing implement holder comprises a housing comprising a hollow interior, an open end and a thread on an exterior surface of the housing; an electric motor disposed within the hollow interior at one end of the housing and having an output shaft thereof aligned with a longitudinal axis of the housing; a source of electric power disposed within the hollow interior and coupled to the motor; a gripping member mounted within the hollow interior of the housing and having one end thereof securely attached to the output shaft of the motor so the gripping member rotates with a rotation of the output shaft, the gripping member comprising one or more tangs or fingers defining a hollow interior of the gripping member, the gripping member being configured to receive and retain, within the hollow interior thereof, a portion of the writing implement for a rotation with the output shaft of the motor, when the writing implement is inserted through the open end of the housing; another housing comprising a hollow interior, an open end and a thread on an interior surface of the another housing and being complimentary to the thread on the exterior surface of the housing, the gripping member comprising two or more fingers coupled to the output shaft and tapers at free distal ends of the two or more fingers; one or more guide members having a center bore with a tapered surface; and a switch operatively coupled in a circuit mediate the electric motor and the power source and operable to selectively supply and discontinue supply of electric power to the motor.

In one exemplary embodiment, an electrically operated writing implement holder comprises a housing comprising a hollow interior, an open end and a spline on an exterior surface of the housing; an electric motor disposed within the hollow interior at one end of the housing and having an output shaft thereof aligned with a longitudinal axis of the housing; a source of electric power disposed within the hollow interior and coupled to the motor; a gripping member mounted within the hollow interior of the housing and having one end thereof securely attached to the output shaft of the motor so the gripping member rotates with a rotation of the output shaft, the gripping member comprising one or more tangs or fingers defining a hollow interior of the gripping member, the gripping member being configured to receive and retain, within the hollow interior thereof, a portion of the writing implement for a rotation with the output shaft of the motor, when the writing implement is inserted through the open end of the housing; another housing comprising a hollow interior, an open end and pin or an abutment extending from an interior surface of the another housing and engaging the spline on the exterior surface of the housing, the gripping member comprising two or more fingers coupled to the output shaft and tapers at free distal ends of the two or more fingers; one or more guide members having a center bore with a tapered surface; and a switch operatively coupled in a circuit mediate the electric motor and the power source and operable to selectively supply and discontinue supply of electric power to the motor.

In one exemplary embodiment, an electrically operated writing implement holder comprises a housing comprising a hollow interior and an open end; an electric motor fixed at one end of the housing and having an output shaft thereof aligned with a longitudinal axis of the housing; a source of electric power coupled to the motor; a gripping member mounted within a hollow interior of the housing and having one end thereof securely attached to the output shaft of the motor, the gripping member configured to receive and retain, within a hollow interior thereof, a portion of the writing implement for a rotation with the output shaft of the motor when the writing implement is inserted through an axially opposite open end of the housing; and means for at least restricting a radial movement of a tip of the writing implement during the rotation thereof.

The chosen exemplary embodiments of the claimed invention have been described and illustrated for practical purposes so as to enable any person skilled in the art to which it pertains to make and use the same. It is therefore intended that all matters in the foregoing description and shown in the accompanying drawings be interpreted as illustrative and not in a limiting sense. It will be understood that variations, modifications, equivalents and substitutions for components of the specifically described exemplary embodiments of the invention may be made by those skilled in the art without departing from the spirit and scope of the invention as set forth in the appended claims.

As used herein, the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa. Similarly, subject matter that is recited as being configured to perform a particular function may additionally or alternatively be described as being operative to perform that function.

As used herein, the term "coupled" includes direct and indirect connections. Moreover, where first and second devices are coupled, intervening devices including active devices may be located there between.

Any element in a claim that does not explicitly state "means for" performing a specified function, or "step for" performing a specified function, is not to be interpreted as a "means" or "step" clause as specified in 35 U.S.C. § 112, ¶6. In particular, any use of "step of" in the claims is not intended to invoke the provision of 35 U.S.C. § 112, ¶6.

Anywhere the term "comprising" is used, embodiments and components "consisting essentially of" and "consisting of" are expressly disclosed and described herein."

Furthermore, the Abstract is not intended to be limiting as to the scope of the claimed invention and is for the purpose of quickly determining the nature of the claimed and/or disclosed subject matter.

What is claimed is:

1. A writing implement holder, comprising:

a housing comprising a hollow interior and an open end;

an electric motor fixed within said hollow interior of said housing, said electric motor comprising an output shaft thereof aligned with a longitudinal axis of said housing;

a source of electric power coupled to said motor;

a switch operatively coupled in a circuit mediate said electric motor and said source of electric power and operable to selectively supply and discontinue supply of electric power to said motor; and a gripping member mounted within said hollow interior of said housing, mediate ends thereof, said gripping member comprising elongated tangs or fingers defining a hollow interior of said gripping member, each elongated tang or finger with a proximal end thereof being securely attached to said output shaft of said motor so that said gripping member rotates with a rotation of said output shaft and with a free distal end being radially disposed at a distance from a free distal end of any adjacent elongated tang or finger, said free distal end of said each elongated tang or finger being radially disposed at a greater distance from said centerline so said each elongated tang or finger being inclined relative to said centerline, said gripping member configured to receive and retain, within said hollow interior thereof, a portion of a writing implement for a rotation with said output shaft of said motor, when the writing implement is inserted through said open end of said housing.

2. The writing implement holder of claim 1, further comprising another hollow housing partially encasing said housing.

3. The writing implement holder of claim 2, wherein each elongated tang or finger extending toward an end of said another housing, wherein distal ends of one or more of said plurality of elongated members are adapted for movement in a radial direction relative to a longitudinal axis of said writing implement holder.

4. The writing implement holder according of 1, wherein one or more from said elongated tangs or fingers includes a plurality of teeth positioned to engage an exterior surface of the writing implement.

5. The writing implement holder according of 1, wherein one or more from said elongated tangs or fingers includes an elastomeric member attached thereto, said elastomeric member positioned to engage an exterior surface of the writing implement.

6. The writing implement holder of claim 1, further including means for at least restricting a radial movement of the writing implement during said rotation thereof.

7. The writing implement holder of claim 6, wherein said means comprises one or more members secured to an inner surface of said housing and being configured to at least partially collapse in a resilient manner to receive the writing implement therethrough.

8. The writing implement holder of claim 6, wherein said means comprises a member secured to an inner surface of said housing and comprising resilient fingers inclined at an angle relative to said longitudinal axis.

9. The writing implement holder of claim 8, wherein one or more of said resilient fingers includes a curved end configured to guide the writing implement into a position aligned with said longitudinal axis.

10. The writing implement holder of claim 1, wherein said housing comprises means for adjusting a length of said housing.

11. The writing implement holder of claim 1, wherein said housing comprises a first portion having said motor attached thereto and a second portion configured for a longitudinal reciprocal movement relative to said first portion.

12. The writing implement holder of claim 11, wherein said first and second portions are provided as a pair of telescopic portions, wherein said second portion comprises one or more indentations defined on an exterior surface of said second portion along a length thereof and wherein said writing implement holder comprises a clip having one end thereof fixed to an exterior surface of said first portion and having an opposite end thereof configured for engagement with a selective one from said one or more indentations.

13. The writing implement holder of claim 11, wherein said first and second portions are adapted with complimentary threads.

14. A writing implement holder comprising:

a housing comprising a hollow interior, an open end and a thread on an exterior surface of said housing;

an electric motor disposed within said hollow interior at one end of said housing and having an output shaft thereof aligned with a longitudinal axis of said housing;

a source of electric power disposed within said hollow interior and coupled to said motor;

a gripping member mounted within said hollow interior of said housing and having one end thereof securely attached to said output shaft of said motor so said gripping member rotates with a rotation of said output shaft, said gripping member comprising one or more tangs or fingers defining a hollow interior of said gripping member, said gripping member being configured to receive and retain, within said hollow interior thereof, a portion of a writing implement for a rotation with said output shaft of said motor, when the writing implement is inserted through said open end of said housing;

another housing comprising a hollow interior, an open end and a thread on an interior surface of said another housing and being complimentary to said thread on said exterior surface of said housing;

a switch operatively coupled in a circuit mediate said electric motor and said source of electric power and operable to selectively supply and discontinue supply of electric power to said motor; and one or more guide members, each of said one or more guide members being configured to guide insertion of the writing implement into said hollow interior of said housing, said hollow interior of said another housing and said hollow interior of said gripping member, said each of said one or more guide members being further configured to restrict if not completely eliminate a radial movement of the writing implement during use of said writing implement holder.

15. The writing implement holder of claim 14, wherein a free distal end of said one or more tangs or fingers comprises a taper.

16. The writing implement holder of claim 14, wherein said each of said one or more guide members comprises a center bore with a tapered surface.

17. The writing implement holder of claim 16, wherein said one or more guide members is two guide members and wherein one of said two guide members is positioned adjacent a free distal end of said gripping member, said free distal end of said gripping member being defined by a free distal end of each of said one or more tangs or fingers.

18. The writing implement holder of claim 14, wherein said each of said one or more guide members is a disk shaped member comprising a center bore that is sized smaller than a circumference of the writing implement, said center bore being configured to flex, in a resilient manner, upon passage of the writing implement therethrough and abut an exterior surface of the writing implement after the writing implement is inserted into the writing implement holder.

* * * * *